US006239419B1

(12) United States Patent
Kim

(10) Patent No.: US 6,239,419 B1
(45) Date of Patent: May 29, 2001

(54) WALL MOUNTED MICROWAVE OVEN

(75) Inventor: Sun-Ki Kim, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/621,967

(22) Filed: Jul. 21, 2000

(30) Foreign Application Priority Data

Nov. 9, 1999 (KR) ..... 99-49519

(51) Int. Cl.[7] ..... H05B 6/80; F24C 15/20

(52) U.S. Cl. ..... 219/757; 219/681; 126/21 A; 126/299 D

(58) Field of Search ..... 219/757, 756, 219/681, 400; 126/21 A, 198, 299 R, 299 D

(56) References Cited

U.S. PATENT DOCUMENTS 4,143,646 * 3/1979 Sampsel ..... 126/299 D
4,418,261 * 11/1983 Jailor et al. ..... 219/757
4,858,591 * 8/1989 Fu ..... 126/299 D
4,886,046 * 12/1989 Welch ..... 126/299 D
5,951,907 * 9/1999 Kang ..... 219/757

* cited by examiner

*Primary Examiner*—Philip H. Leung
(74) *Attorney, Agent, or Firm*—Robert E. Bushnell, Esq.

(57) ABSTRACT

A wall-mounted microwave oven having a main body forming a cavity into which food to be cooked is put and a casing enclosing the main body is provided. The casing includes a suction port on its bottom, a discharge port on its top, and a hood fan installed adjacent to the discharge port. A fan case in which the hood fan is housed, includes an outlet communicating with the discharge port of the casing and an inlet communicating with the suction port of the casing. An air pipe connected to the suction port of the casing at one end thereof and connected to the inlet of the fan case at the other end thereof guides air from the suction port into the inlet of the fan case.

20 Claims, 4 Drawing Sheets

WALL MOUNTED MICROWAVE OVEN

CLAIM OF PRIORITY

This application makes reference to, incorporates the same herein, and claims all benefits accruing under 35 U.S.C. §119 from an application for WALL MOUNTED MICROWAVE OVEN earlier filed in the Korean Industrial Property Office on the Nov. 9, 1999 and there duly assigned Serial No. 49519/1999.

BACKGROUND OF THE INVENTION

1. Technical Field

The present invention relates to a wall-mounted microwave oven, and more particularly, a wall-mounted microwave oven having an air pipe assembly for air exhaust.

2. Related Art

A wall-mounted microwave oven 1 is generally mounted on the wall over a gas range 50 as depicted in FIGS. 1 and 4. The wall-mounted microwave oven additionally functions as a hood to discharge fumes or smoke generated from the gas range 50 while food is cooked on the gas range 50.

The conventional wall-mounted microwave oven includes a main body 3 having a cavity 4 in which food to be cooked is put and a casing 6 enclosing the main body 3 spaced apart from the casing 6. A magnetron 30 generating microwaves to be supplied into the cavity 4 is installed in a space formed between the main body 3 and the casing 6. The magnetron 30 is supplied with high-voltage current through a high-voltage transformer not shown and a high-voltage condenser not shown. A fan cooling the magnetron 30 is installed adjacent to the magnetron 30.

The casing 6 is comprised of an upper casing 6*a* enclosing the top and both sides of the main body 3 and a lower casing 6*b* enclosing the bottom of the main body 3. The space formed between both side walls of the upper casing 6*a* and the main body 3 constitutes a hood duct 15 functioning as a path for discharging the fumes and smoke generated from the gas range 50 and introduced into the space. A pair of suction ports 8 allowing the fumes and smoke to flow into the hood duct 15 are formed on the lower casing 6*b*, and a discharge port 9 is formed on the top of the upper casing 6*a* in order to discharge the fumes and smoke blown into the hood duct. An exhaust pipe 11 is assembled to an outer surface of the discharge ports 9, and is extended to an exhaust path 17 opened toward the outside of the wall.

A hood fan 13 is installed in an upper area of the main body 3 adjacent to the discharge port 9 to discharge the fumes and smoke blown into the hood duct 15 through the suction ports 8 to the outside of the wall-mounted microwave oven 1 through the discharge port 9. On the bottom of the upper casing 6*b* is installed a hood lamp 55 for illuminating the gas range 50.

Even though a space is formed between the casing 6 and the main body 3 and the hood duct 15, and the casing 6 is spaced-apart from the main body 3, there is no provision for maintaining an airtightness therebetween. Thus, air remaining in a space formed between the casing 6 and the main body 3 or air blown into the magnetron 30 by the fan (not shown) for cooling the magnetron 30 is likely to be drawn into the hood duct 15 when the hood fan 13 operates. The air drawn into the hood duct 15 is discharged to the outside together with the fumes and smoke drawn into the hood duct 15 through the suction ports 8. The fumes and smoke can be blown into the inside of the main body through gaps between the casing and the main body.

Conventionally, the capacity of the hood fan 13 is preset depending upon the amount of air flowing into the hood duct 15 through the suction ports 8. Therefore, where the air remaining between the casing 6 and the main body 3 is drawn into the hood duct 15 and then discharged outside, the amount of air drawn through the suction ports 8 and discharged outside is dependently reduced. Thus, the efficiency of discharging the air through the suction port is lowered.

SUMMARY OF THE INVENTION

Accordingly, an object of the present invention is to provide a wall-mounted microwave oven having an improved efficiency of air exhaust.

It is another object to provide a wall-mounted microwave oven able to keep fumes and smoke from being drawn into a main body having a magnetron.

It is also an object to provide a wall-mounted microwave oven having an exclusive passageway for fume and smoke drawn into and exhausted outside of the oven.

These and other objects may be achieved by providing a wall-mounted microwave oven including a main body having a cavity into which food to be cooked is put, a casing enclosing the main body, a space formed between the casing and the main body, the casing having a suction port on its bottom and a discharge port on its top connected to the suction port through the space, and a hood fan installed adjacent to the discharge port. The wall-mounted microwave oven further includes a fan case in which the hood fan is housed. The fan case includes an outlet communicating with the discharge port of the casing, an inlet communicating with the suction port of the casing, and an air pipe connected to the suction port of the casing at one end thereof and connected to the inlet of the fan case at the other end thereof, for guiding air from the suction port into the inlet of the fan case.

The air pipe disposed within the space between the casing and the main body has a guide part, a tubular guide part formed on one end of the guide part and connected to the inlet of the fan case, and a suction head formed on the other end of the guide part and connected to the suction port of the casing. The guide part can be made of a flexible material, resulting in conveniently installing the air pipe within the space.

The wall-mounted microwave oven further includes a rib protruding from the suction port of the casing toward the main body to which the suction head is coupled. The rib serves to securely install the suction head on the suction port.

A male screw is formed on an outer circumferential surface of the inlet of the fan case and a female screw corresponding to the male screw is formed on an inner circumferential surface of the guide part. The air pipe can be securely coupled to the fan case with both screws.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, an embodiment according to the principle of the present invention will be described in detail with reference to the accompanying drawings.

Figure 1:
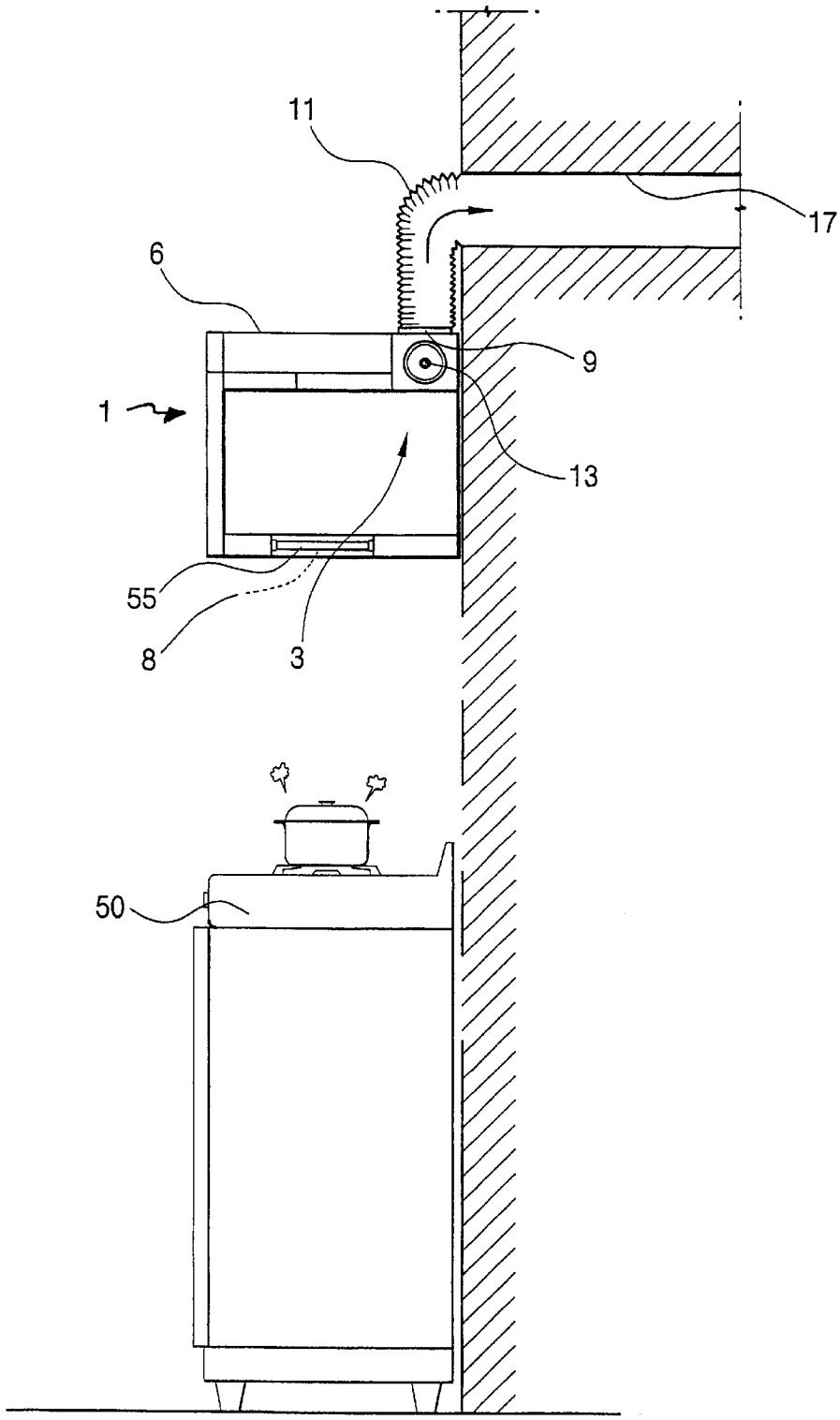
FIG. 1 is a perspective view of a wall-mounted microwave oven showing its installation on the wall.
Figure 2:
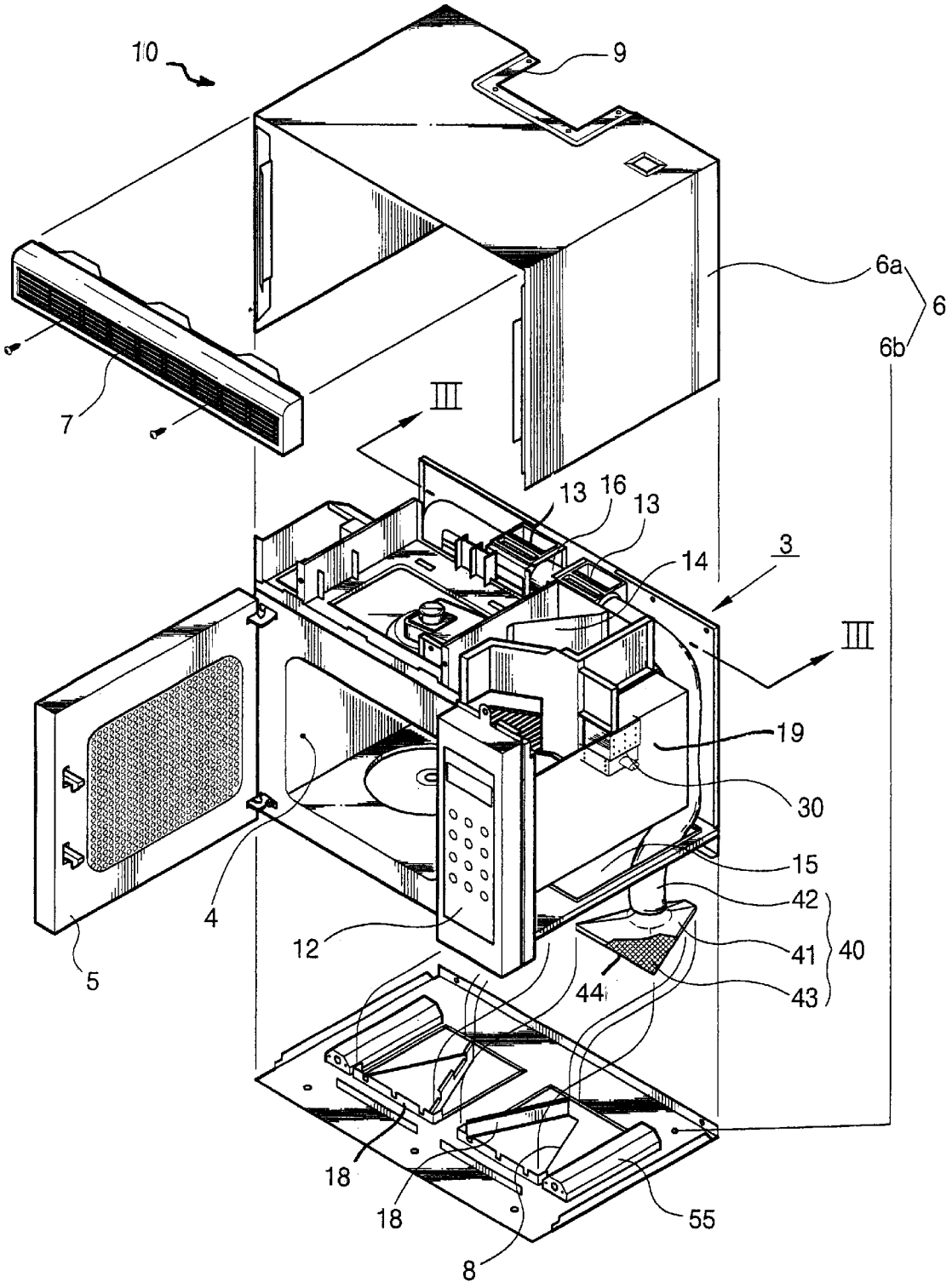
FIG. 2 is an exploded perspective view of a wall-mounted microwave oven according to the present invention.
Figure 3:
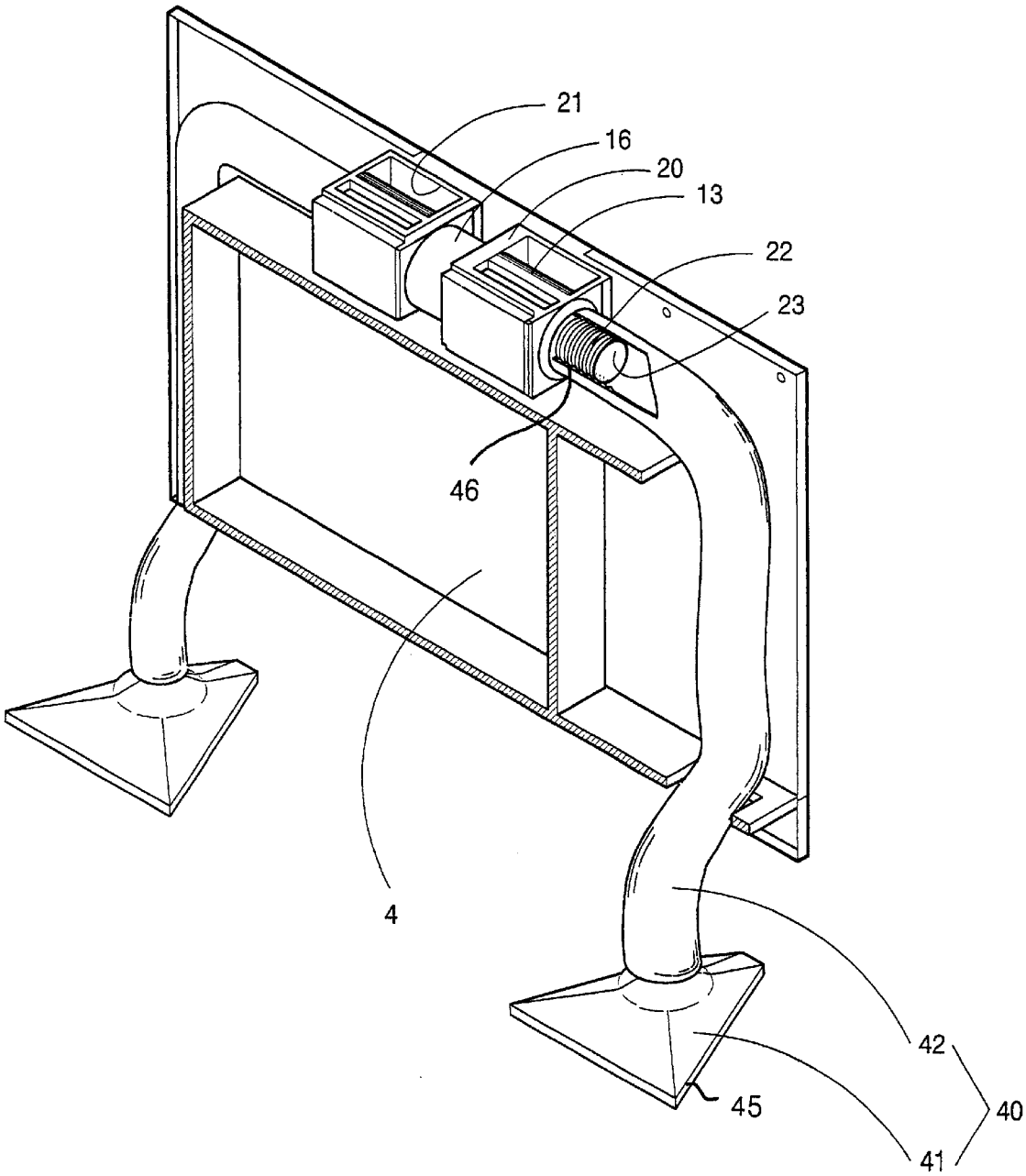
FIG. 3 is a partial perspective view taken along line III—III of FIG. 2.
Figure 4:
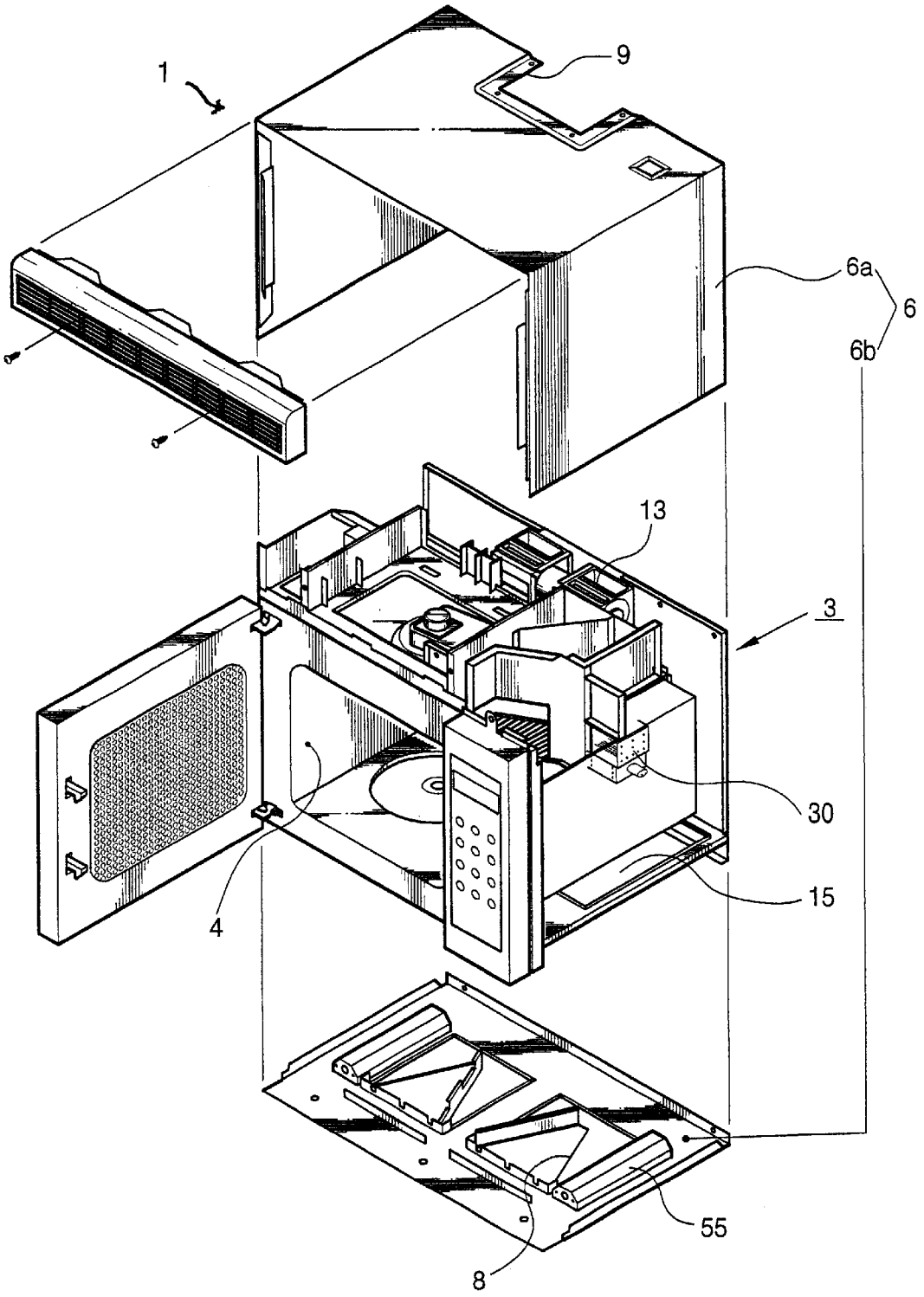
FIG. 4 (PRIOR ART)
FIG. 4 is an exploded perspective view of a conventional wall-mounted microwave oven.

Turning now to FIGS. 2 and 3, a wall-mounted microwave oven according to the present invention includes a casing 6 defining an outer appearance and a main body 3 formed with a cavity 4 and a component chamber 19.

A suction grill 7 is installed on an upper front area of the main body 3, and a duct member 14 guiding movement of air down through suction grill 7 is installed on a top area of the main body 3. A door 5 is hingedly assembled to the main body 3 in the front thereof for opening and closing the cavity 4. A control panel 12 having a number of buttons for operating the microwave oven is installed on a front area of the component chamber 19. Within the component chamber 19 is installed a magnetron 30 generating microwaves to be supplied into the cavity 4. A fan not shown for cooling the magnetron 30 is installed adjacent to the magnetron 30. On the bottom of the component chamber 19 are installed a high-voltage transformer not shown and a high-voltage condenser not shown.

The casing 6 is comprised of an upper casing 6*a* enclosing the top and both sides of the main body 3 and a lower casing 6*b* enclosing the bottom of the main body 3. The upper casing 6*a* has a discharge port 9 formed on a planar surface of the upper casing 6*a*, and the lower casing 6*b* has a pair of suction ports 8.

A pair of hood fans 13 are installed in parallel adjacent to the discharge port 9 for discharging air drawn in through the suction ports 8 outside of the wall-mounted microwave oven 10 through the discharge port 9. Between the hood fans 13 is installed a fan motor 16 driving each of the hood fans 13. The hood fans 13 are housed in their respective rectangular fan cases 20. Each of the fan cases 20 has its respective inlet 23 guiding air drawn in through the suction ports 8 into the fan cases 20. On the top parts of the fan cases 20 are formed outlets 21 communicating with the discharge port 9.

Between both side walls of the upper casing 6*a* and the main body 3 is formed a hood duct 15 guiding the air drawn in through the suction ports 8 into the discharge port 9. The hood duct 15 is partitioned relative to the component chamber. A pair of air pipes 40 are installed in the hood duct 15 and connect the suction ports 8 of the lower casing 6*b* and the inlet parts 23 of the fan cases 20 for guiding air from the suction ports 8 into the inlet 23. Each air pipe 40 has a tubular guide part 42 and a suction head 41 formed at a lower end portion of the guide part 42. The guide part 42 is made of a flexible material, thereby making it easy to install the air pipe 40. At an upper end portion of the guide part 42, in the inner diameter, is formed a female screw thread 46. A male screw 22 formed on an outer circumferential surface of the inlet 23 is coupled to the female screw thread 46 formed on the inner circumferential surface of the guide part 42 of the air pipe 40.

The suction head 41 is almost funnel-shaped, and the opening 44 of the suction head 41 is covered with a net member 43. If the suction head 41 is combined with the suction port 8, the net member 43 is exposed outward, thereby giving a good appearance. A rib 18 protruding toward the main body 3 is formed on an edge portion of the suction port 8. The suction head 41 is securely installed to the suction port 8 by a combination of the rib 18 and a corresponding portion 45 of the suction head 41.

With this configuration, when the hood fans 13 are operated, heated air generated from the gas range 50 is drawn into the suction ports 8 by a suction force of the hood fans 13. The air drawn through the suction port 8 and suction head 41 passes along the guide part 42, blows into the fan cases 20 through the inlet 23, and then is discharged outside of the wall-mounted microwave oven 10 through the discharge port 9.

In the wall-mounted microwave oven 10 according to the principle of the present invention, the airtightness of the air path formed between the suction port 8 and the discharge port 9 can be maintained by the air pipe 40 so that the suction force of the hood fan 13 is only applied to the inside of the air pipe 40. Accordingly, loss of the suction force of the hood fan 13 can be prevented, thereby improving the efficiency of air exhaust by means of the hood fan.

The embodiment of the present invention described above only discloses the case where the air pipe 40 is formed inside the hood duct 15. However, the same effects can also be accomplished where the air pipe 40 is installed in any space formed between the casing 6 and the main body 3 instead of the space formed in the hood duct 15.

The above-described embodiment of the present invention discloses the female screw 46 formed in the guide part 42 of the air pipe 40 and coupled to the male screw 22 formed on the inlet 23. However, a hook formed at the air pipe 40 can be coupled to a hook hole formed at the fan case 20.

Although the present invention has been described in connection with an embodiment thereof, it will be appreciated by those skilled in the art that additions, modifications, substitutions and deletions not specifically described may be made without departing from the spirit and scope of the invention as defined in the appended claims.

What is claimed is:

1. A wall-mounted microwave oven, comprising;

a main body forming a cavity and having a component chamber;

a casing enclosing said main body, having a suction port formed on a bottom plate of said casing and communicating with an outside of said casing having a discharge port formed on a top plate of said casing;

a hood fan installed adjacent to said discharge port;

a fan case housing said hood fan, having an outlet communicating with said discharge port of said casing and an inlet communicating with said suction port of said casing; and a pipe having an one end connected to said suction port of said casing other than said cavity and said component chamber having the other end connected to said inlet of said fan case guiding air from said suction port into said inlet of said fan case.

2. The wall-mounted microwave oven of claim 1, said pipe comprising a tubular guide part having a suction head coupled to said suction port of said casing.

3. The wall-mounted microwave oven of claim 2, wherein said tubular guide part is made of a flexible material.

4. The wall-mounted microwave oven of claim 2, further comprising a rib formed on said suction port, protruded toward said main body from said suction port of said casing, and coupled to said suction head is combined.

5. The wall-mounted microwave oven of claim 2, wherein a male screw thread is formed on said inlet of said fan case, and a female screw thread corresponding to said male screw thread is formed in said guide part of said air pipe.

6. The wall-mounted microwave oven of claim 1, said pipe comprising a suction head formed on said one end of said pipe and coupled to said suction port of said casing.

7. The wall-mounted microwave oven of claim 1, said pipe comprising a female screw thread formed on said other end of said pipe and coupled to said inlet of said fan case.

8. The wall-mounted microwave oven of claim 7, said fan case comprising a male screw thread formed on said inlet of said fan case and coupled to said female screw thread of said pipe.

9. The wall-mounted microwave oven of claim 1, said pipe having a first connector formed on said one end of said pipe and connected to said inlet of said fan case.

10. The wall-mounted microwave oven of claim 9, said fan case comprising a second connector coupled to said fist connector of said pipe.

11. The wall-mounted microwave oven of claim 1, said pipe disposed between said casing and said main body.

12. The wall-mounted microwave oven of claim 1, said pipe exclusively coupling said suction port of said casing to said inlet of said fan case.

13. A microwave oven comprising:

a main body having a cavity and a component chamber;

a casing enclosing said main body, having a suction port and a discharging port, both said suction port and said discharging port communicated with an outside of said casing other than said cavity and said component chamber;

a fan case having an outlet coupled to said discharging port of said casing, an inlet, and a fan mounted between said inlet and said outlet; and a pipe disposed within a duct formed between said casing and said main body to exclusively couple said suction port of said casing to said inlet of said fan case.

14. The microwave oven of claim 13, said pipe comprising a suction head coupled to said suction port of said casing, said suction head guiding air drawn through said suction port into the inside of said pipe and preventing said air from being discharged into said space.

15. The microwave oven of claim 13, said inlet of said fan case comprising a first connector formed on said inlet and coupled to a second connector formed on said pipe.

16. The microwave oven of claim 13, said inlet of said fan case comprising a first screw thread formed on said inlet and coupled to a second screw thread formed on said pipe.

17. The microwave oven of claim 13, said pipe comprising a suction head formed on one end of said pipe and connected to said suction port, a connector formed on the other end of said pipe and connected to said inlet, and a guide part coupling said suction head to said connector.

18. The microwave oven of claim 17, said guide part being made of a flexible material.

19. The microwave oven of claim 17, said connector comprising a screw thread coupled to a second screw thread formed on said inlet of said fan case.

20. The microwave oven of claim 13, said pipe being made of a flexible material.

* * * * *